United States Patent [19]

Schnizler, Jr. et al.

[11] 4,192,982

[45] Mar. 11, 1980

[54] DEADMAN'S SWITCH

[75] Inventors: Albrecht Schnizler, Jr., Nuertingen; Hermann Kieser, Nuertingen-Oberensingen, both of Fed. Rep. of Germany

[73] Assignee: Metabowerke GmbH & Co., Nürtingen, Fed. Rep. of Germany

[21] Appl. No.: 930,546

[22] Filed: Aug. 2, 1978

[30] Foreign Application Priority Data

Aug. 13, 1977 [DE] Fed. Rep. of Germany ..... 2736613

[51] Int. Cl.[2] ..... H01H 3/20

[52] U.S. Cl. ..... 200/157; 200/153 T; 200/322; 200/325; 200/330

[58] Field of Search ..... 200/330, 332, 334, 321, 200/322, 153 T, 157, 61.85, 325

[56] References Cited

U.S. PATENT DOCUMENTS 3,881,081 4/1975 Schilling et al. ..... 200/321 X

*Primary Examiner*—Frederick R. Schmidt

*Attorney, Agent, or Firm*—Michael J. Striker

[57] ABSTRACT

A switch includes an actuating element movable against a biasing force from a rest into a working position. The element is engageable with a member movable under a force of a predetermined magnitude applied thereto between a first position corresponding to the rest position of the element and a second position in which it displaces the element into the working position. The member is provided with a spring for urging the member against the applied force into the first position so as to release the actuating element. The member tends to prematurely move into the first position in response to a slight decrease of the applied force to a lever below the predetermined magnitude. The switch is further provided with an arrangement for preventing the premature movement of the member into the first position until after the applied force decreases below the abovementioned level.

23 Claims, 2 Drawing Figures

DEADMAN'S SWITCH

BACKGROUND OF THE INVENTION

The present invention relates to switches, and more particularly to deadman's switches.

It is known in the art of deadman's switches to provide a movable actuating element with a spring for urging the actuating element from a working position in which the switch is closed into a rest position in which a switch is open. On the other hand, such a switch is provided with an actuating member engageable with the actuating element and movable so as to displace the latter against the biasing force of the spring from the rest into the working position. Usually the member is also provided with a spring which is operative to counteract the force applied to the member when the latter moves into engagement with the actuating element.

Therefore, it is to be understood that in such a switch the actuating member is subject to considerable forces, on the one hand, a force applied to move the latter into engagement with the actuating element and, on the other hand, the counteracting forces of the springs. This is especially true if a control distance of the switch is comparatively small, which is the case with deadman's switches.

When a user operates such a deadman's switch for a relatively long time period, a situation may take place where the user slightly decreases the applied force not purposely but inadvertantly, if, for example, the user is tired and exhausted. If this is the case, even the slightest release of the actuating member will most likely lead to premature opening the switch, with subsequent undesirable results, for example premature stopping of a moving vehicle if such a deadman's switch is installed in the system of operation of the vehicle.

SUMMARY OF THE INVENTION

It is a general object of the present invention to avoid the disadvantage of the prior art deadman's switches.

More particularly, it is an object of the present invention to provide such a deadman's switch which is more reliable in operation than the known deadman's switches.

Another object of the present invention is to provide a deadman's switch which requires a relatively small force to actuate the latter.

Still another object of the present invention is to provide a deadman's switch which ensures that the stop of the arrangement to which the switch is operatively connected will not follow immediately after releasing the actuating member.

In pursuance of these objects and others which will become apparent hereafter, one feature of the present invention resides in an actuating element movable against a biasing force from a rest position in which the switch is open to a working position in which the switch is closed. The actuating element is engageable with a member which is movable under a force of a predetermined magnitude applied thereto between a first position corresponding to said rest position of said element and a second position in which it displaces said element into said working position. The switch is further provided with first resilient means for normally urging said member against the applied force into said first position so as to release the actuating element and open the switch. The member tends to prematurely move into said first position in response to a slight decrease of the applied force to a level below said predetermined magnitude. Means (for example, a movable lever) are provided in order to prevent the premature movement of said member into said first position until after the applied force decreases below said level.

In accordance with such a construction of the deadman's switch, the first force required for retaining the member into engagement with the actuating element does not affect the second force required for retaining the preventing means in its corresponding position. Therefore, the second force can be relatively small regardless of the first force which can be chosen relatively large. Correspondingly, the control distance of the movement of the lever can be chosen relatively big, so that a slight release of the lever will not lead immediately to open the switch of an electrical arrangement to which, for example, the switch can be operatively connected. The switch is open only when the lever is released completely, in other words when the decrease of the applied force reaches a predetermined magnitude.

In accordance with another advantageous feature of the present invention the lever is pivotably mounted on a free end of the pivotable member, for pivoting about an axis which differs from that the member pivots about. In one of its pivoting positions the lever engages an arresting arrangement, which position corresponds to the working position of the actuating element. Due to such an arrangement the force exercised on the level is relatively small. The arresting arrangement is provided with a first shoulder engageable with a corresponding shoulder of the lever.

It is to be understood that such an arrangement is relatively simple. Actually, there may be only one troublesome situation, in which the first shoulder due to a biasing force moves towards the second shoulder and they together are snapped by the member with the lever. In order to avoid such a situation the first shoulder is provided on one end portion of a plate which is movable due to the urging force of a spring. Thus, the plate can be also biased by a spring. The portion which is provided with the first shoulder can be of rather thin cross-section, so that the position of such portion is defined by the force of the corresponding spring abutted against this portion.

Such a construction can be especially inexpensive, if the switch is provided with a support which has one end portion for supporting the actuating member, another end portion for supporting a retaining spring for urging the actuating member away from the switch and an intermediate portion for supporting the arresting arrangement engageable with the lever. Further, the support may be provided with U-shaped angle portion. One arm of such a portion serves as a portion carrying the first shoulder. The thus-defined U-shaped recess can receive the spring which is supported against the portion carrying the above-mentioned first shoulder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
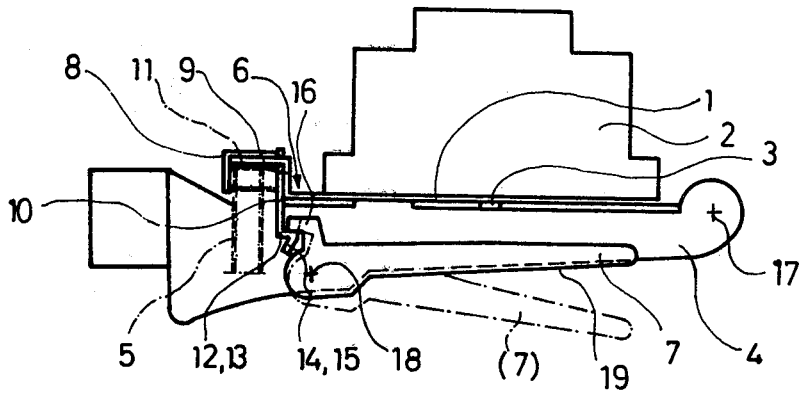
FIG. 1 is a side view of a deadman's switch in a working position, in accordance with the present invention.
Figure 2:
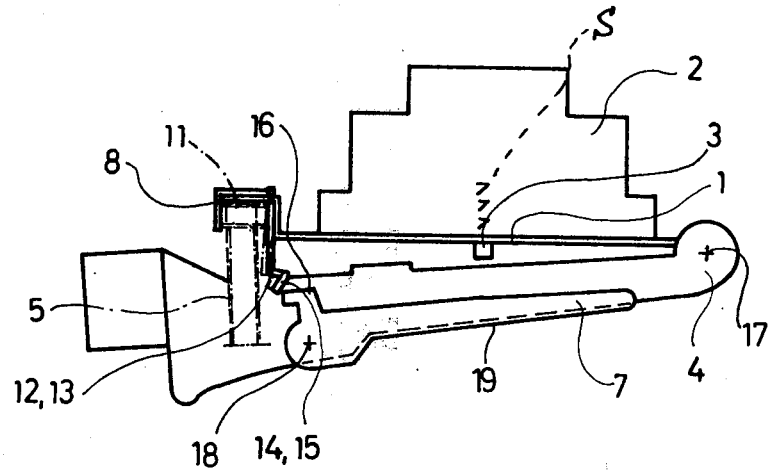
FIG. 2 is a side view of the deadman's switch in a rest position.

Referring now to the drawings and first to FIG. 1 thereof, it may be seen that the reference numeral 1 designates a support operative for supporting a switch 2 (for example a deadman's switch). The switch 2 is provided with an actuating element 3 which is engageable with a member 4. The member 4 moves the actuating element 3 from a rest position, in which the switch is open (see FIG. 2) into a closed position in which the switch is closed (see FIG. 1). The actuating element 3 is provided with resilient means for urging the element 3 into its rest position. The resilient means may include, for example, a spring S or any other elements appropriate for this purpose. There is also provided a spring 5 for urging the member 4 away from the switch 2, in other words in a direction so as to release the actuating element 3. Thus, in order to move the actuating element 3 from the rest into the closed position, a force has to be applied onto the member 4 exceeding the biasing forces of the springs S and 5. Obviously, the applied force has to be relatively big all the time if it is desirable to keep the switch closed.

It is to be understood that to keep the applied force at a required magnitude is a rather tiresome task. A situation may occur, where the applied force slightly decreases, due to the fact for example that a user becomes tired (e.g. muscular fatigue).

Therefore, it is very likely that the member 4 will, immediately after such a force decreases, be urged by the spring 5 away from the actuating element 3, thus releasing the latter and opening the switch.

In order to prevent such a premature movement of the member 4 from the element 3, there is provided an arresting arrangement 6. The arresting arrangement 6 engages a lever 7 when the member 4 moves towards the actuating element 3. The lever 7 is mounted on a free end of the member 4 (and is pivotable about an axis 17) for movement therewith.

The support 1 is provided adjacent to the free end of the member 4 with a U-shaped angle portion 8. An arm 9 of the portion 8 is provided with a rather thin plate 10 which is biased by a spring 11. The plate 10 in its turn is provided with a double angle portion, where a first angle portion 12 defines a shoulder 13 and a second angle portion 14 defines a slope 15 which is engageable with a corresponding shoulder 16 of the lever 7. The shoulder 16 engages the shoulder 13 when the member 4 is in a position corresponding to the working position of the actuating element 3. Should the manually-operated lever 7 be released, then the latter takes up a position indicated in FIG. 1 by a dot-dash line in response of the force of the spring 11, thus releasing the shoulder 16. Thus, the member 4 is released and moves under the force of the spring 5 in direction away from the actuating element 3. Having been released, the actuating element 3 moves in response to the force of the spring S into its rest position.

In order to close the deadman's switch the lever 7 is pressed with the member 4. The shoulder 16 slides along the slope 15 of the plate 10 and moves the latter against the spring 11, so that the shoulder 16 engages the corresponding shoulder 13. Thus, the lever 7 is arrested by the arrangement 6. Such a construction ensures that an insignificant decrease of the force applied to the lever 7 will not result in disengagement of the latter with the arresting arrangement 6, therefore the engagement between the member 4 and the actuating element 3 will not be affected. Prior to releasing the actuating element 3, the lever 7 has to be completely disengaged with the arresting arrangement 6. Only then, the member 4 can move under the force of the spring 5 into the rest position. When the member 4 is released, it pivots about the axis 17, which connects the member 4 with the support 1. Accordingly, the lever 7 pivots about the axis 18 in the position corresponding to the rest position of the actuating element. A force which is required to be applied to the lever 7 is comparatively small because the shoulder 16 is spaced from the axis 18 by a distance equal one-tenth of the length of the free arm 19 of the lever 7.

It will be understood that each of the elements described above, or two or more together, may also find a useful application in other types of a deadman's switch differing from the types described above.

While the invention has been illustrated and described as embodied in a deadman's switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A switch, particularly a deadman's switch, comprising an actuating element movable against a biasing force from a rest position in which the switch is open to a working position in which the switch is closed; a member engageable with said element and movable under a force of a predetermined magnitude applied thereto between a first position corresponding to said rest position of said element and a second position in which it displaces said element into said working position; first resilient means for normally urging said member against the applied force into said first position so as to release the actuating element and open the switch, said member tending to prematurely move into said first position in response to a slight decrease of the applied force to a level below said predetermined magnitude: and means for maintaining said member in said second position when the applied force decreases above said level and allowing said member to move into said first position once the applied force decreases below said level.

2. A switch as defined in claim 1, wherein said maintaining means comprise a lever mounted on said member for joint movement therewith between said first and second positions.

3. A switch as defined in claim 2, wherein said member and said lever extend substantially parallel to one another.

4. A switch as defined in claim 2, wherein said lever is a two-armed lever.

5. A switch as defined in claim 2, wherein said maintaining means further comprise a stationary arrangement having a projection adapted to engage said lever when the latter moves with said member into said second position and disengage when said applied force decreases below said level.

6. A switch as defined in claim 5, wherein said projection is a plate having a relatively thin cross-section.

7. A switch as defined in claim 5, further comprising a support having one end portion operative for supporting said member, another end portion operative for supporting said first resilient means and an intermediate portion operative for supporting said arrangement.

8. A switch as defined in claim 7, wherein said other of said end portions of said support has a bent configuration, one arm of which being operative for supporting said projection.

9. A switch as defined in claim 8, wherein another arm of said other of said end portions of the support bounds with said projection, a U-shaped recess operative for closely receiving therein said first resilient means supported between said another arm and said projection.

10. A switch as defined in claim 5, wherein said member has one end pivotably mounted for pivoting about a first axis and another free end; said lever being mounted on said free end of said member.

11. A switch as defined in claim 10, wherein said lever is pivotably mounted on said free end of said member for pivoting about a second axis relative to said member.

12. A switch as defined in claim 11, wherein said lever is provided with a first shoulder adapted to engage said projection when said member moves into said second position.

13. A switch as defined in claim 12, wherein said lever has one arm provided with said first shoulder spaced from said second axis by a predetermined distance and another arm.

14. A switch as defined in claim 13, wherein said other of said arms of said lever is arranged along the elongation of the member.

15. A switch as defined in claim 13, wherein said predetermined distance is substantially equal to one-tenth of the length of said other of said arms of said lever.

16. A switch as defined in claim 12, wherein said arrangement is further provided with third resilient means normally urging said projection in a first direction towards said first shoulder of the lever.

17. A switch as defined in claim 16, wherein said projection is movable in a second direction counter to said first direction under a force applied to said projection from said first shoulder when said lever with said member move between said first and second positions.

18. A switch as defined in claim 17, wherein said projection has a first elongated portion provided with an angular end portion relative to the elongation of the first portion.

19. A switch as defined in claim 18, wherein said angular portion comprises a first angular portion and a second angular portion so shaped relative to each other as to define a second shoulder corresponding and adapted to engage said first shoulder of said lever.

20. A switch as defined in claim 1, wherein said actuating element is provided with second resilient means normally urging with said biasing force said actuating element into said rest position.

21. A switch as defined in claim 20, wherein said second resilient means comprise a second spring.

22. A switch as defined in claim 1, wherein said first resilient means comprise a first spring.

23. A switch, particularly a deadman's switch, comprising an actuating element movable against a biasing force from a rest position in which the switch is open to a working position in which the switch is closed; a member engageable with said element and movable under a force of a predetermined magnitude applied thereto between a first position corresponding to said rest position of said element and a second position in which it displaces said element into said working position, said member having one end pivotably mounted for pivoting about a first axis and another free end; first resilient means for normally urging said member against the applied force into said first position so as to release the actuating element and open the switch, said member tending to prematurely move into said first position in response to a slight decrease of the applied force to a level below said predetermined magnitude; second resilient means normally urging with said biasing force said actuating element into said rest position; and means for preventing the premature movement of said member into said first position until after the applied force decreases below said level, and including a lever having a first shoulder and pivotably mounted on said free end of said member for pivoting about a second axis relative to said member and for joint movement with the latter between said first and second positions, and a stationary arrangement having a projection adapted to engage said first shoulder of said lever when the latter moves with said member into said second position and disengage when said applied force decreases below said level, said arrangement including third resilient means normally urging said projection in a first direction towards said first shoulder of the lever.

* * * * *